US011920595B2

(12) United States Patent
Park et al.

(10) Patent No.: US 11,920,595 B2
(45) Date of Patent: Mar. 5, 2024

(54) COMPRESSOR

(71) Applicant: LG Electronics Inc., Seoul (KR)

(72) Inventors: Sangbaek Park, Seoul (KR); Nayoung Jeon, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/162,215

(22) Filed: Jan. 31, 2023

(65) Prior Publication Data

US 2023/0374989 A1 Nov. 23, 2023

(30) Foreign Application Priority Data

May 19, 2022 (KR) ..... 10-2022-0061560

(51) Int. Cl.
*F04C 2/34* (2006.01)
*F04C 18/02* (2006.01)
(Continued)

(52) U.S. Cl.
CPC ..... *F04C 29/026* (2013.01); *F04C 18/0215* (2013.01); *F04C 23/008* (2013.01)

(58) Field of Classification Search
CPC .. F04C 29/026; F04C 18/0215; F04C 23/008; F04C 18/344; F04C 2/3448; F25B 43/02; F25B 43/043
See application file for complete search history.

(56) References Cited

U.S. PATENT DOCUMENTS 5,037,278 A 8/1991 Fujio et al.
5,087,170 A * 2/1992 Kousokabe ..... F04C 29/025 415/110
(Continued)

FOREIGN PATENT DOCUMENTS

JP 2004-324521 11/2004
KR 20060120389 A * 11/2006 ..... F04C 29/026
(Continued)

OTHER PUBLICATIONS

English translation of KR 20060120389 by PE2E May 14, 2023.*
(Continued)

*Primary Examiner* — Deming Wan
(74) *Attorney, Agent, or Firm* — Fish & Richardson P.C.

(57) ABSTRACT

The present disclosure relates to is a compressor. The compressor may be provided with a communication hole between an inlet and an outlet of a refrigerant discharge pipe coupled through an upper surface of a casing, the communication hole penetrating between an outer circumferential surface and an inner circumferential surface of the refrigerant discharge pipe. Thus, during oil sealing through the refrigerant discharge pipe, a flux path area of a driving motor may be ensured, and a number of winding wires and/or a coil diameter of a stator coil may be ensured. Thus, efficiency of the driving motor may be maintained and backflow or overflow of oil through the refrigerant discharge pipe may be suppressed. In addition, during operation of the compressor, oil may be suppressed from being excessively leaked through the refrigerant discharge pipe without having to include a separate oil separator inside or inside the casing.

18 Claims, 10 Drawing Sheets

(51) Int. Cl.

| | |
|---|---|
| ***F04C 18/34*** | (2006.01) |
| ***F04C 23/00*** | (2006.01) |
| ***F04C 29/02*** | (2006.01) |
| ***F25B 43/02*** | (2006.01) |

(56) References Cited

U.S. PATENT DOCUMENTS

| | | | | |
|---|---|---|---|---|
| 5,421,709 | A | 6/1995 | Hill et al. | |
| 2005/0106041 | A1 | 5/2005 | Kitamura et al. | |
| 2012/0156072 | A1* | 6/2012 | Usui | F01C 21/10 417/437 |
| 2014/0023542 | A1* | 1/2014 | Yamashita | F04C 18/0215 418/55.6 |

FOREIGN PATENT DOCUMENTS

| | | | | |
|---|---|---|---|---|
| KR | 20180090677 A * | 8/2008 | | F04C 29/026 |
| KR | 102304191 | 9/2021 | | |

OTHER PUBLICATIONS

English translation of KR 20180090677 by PE2E May 14, 2023.*
Extended European Search Report in European Appln. No. 22217268.6, dated Oct. 6, 2023, 5 pages.
Office Action in Korean Appln. No. 10-2022-0061560, dated Sep. 13, 2023, 10 pages (with English translation).

* cited by examiner

COMPRESSOR

CROSS-REFERENCE TO RELATED APPLICATION

Pursuant to 35 U.S.C. § 119(a), this application claims the benefit of the earlier filing date and the right of priority to Korean Patent Application No. 10-2022-0061560, filed on May 19, 2022, the contents of which are incorporated by reference herein in their entirety.

TECHNICAL FIELD

The present disclosure relates to a compressor, more particularly, a compressor in which oil is sealed into a refrigerant discharge pipe.

BACKGROUND

A compressor applied to a refrigeration cycle such as a refrigerator or an air conditioner serves to compress refrigerant gas and transmit the compressed refrigerant gas to a condenser. A rotary compressor or a scroll compressor is mainly applied to an air conditioner. Recently, the scroll compressor is applied even not only to the air conditioner but also to a compressor for hot water supply that requires a high compression ratio than the air conditioner.

The compressor may be classified into a hermetic compressor in which a driving unit (or a motor part) and a compression part are included together in a casing, and an open-type compressor in which a driving unit (or a motor part) is included outside a casing and only a compression part is included in the casing.

The compressor may be classified into a top compression type compressor and a bottom compression type compressor according to locations of a driving motor constituting a driving unit or a motor part, and a compression part. The top compression type compressor is a compressor type in which a compression part is located above a driving motor, and the bottom compression type compressor is a compressor type in which a compression part is located below a driving motor. This classification is based on an example in which a casing is installed as a vertical type or a standing type. When a casing is installed as a horizontal type, a left side may be classified as an upper side and a right side may be classified as a lower side for convenience.

The compressor may be respectively classified into a low-pressure type compressor in which an inner space of a casing including a compression part provides suction pressure and a high-pressure type compressor in which an inner space of a casing including a compression part provides discharge pressure. The top compression type compressor may be configured as a low-pressure type or a high-pressure type. However, the bottom compression type compressor is generally configured as a high-pressure type compressor in consideration of a position of a refrigerant suction pipe.

A constant amount of oil is sealed into the compressor described above, and the sealed oil is pumped through a rotating shaft during operation of the compressor to lubricate a sliding portion in a compression part and/or a sliding portion between the compression part and the rotating shaft. This oil may be mixed with refrigerant discharged from the compression part and leaked to outside of the compressor through a refrigerant discharge pipe. Then, friction loss or abrasion due to oil shortage may occur in the compressor.

Thus, in the related art, a method of providing an oil separation device separately in an inner space of a casing is disclosed. In some examples, an oil separation member is installed between a driving motor and a discharge pipe, i.e., in a casing. This may reduce a cost of manufacturing a compressor including an oil separation device, compared to when a separate oil separation device is installed outside a casing.

However, when a separate oil separation device is included in a casing in the related art, a number of parts may increase thereby increasing a manufacture cost. In addition, efficiency of the compressor may deteriorate due to excessive increase in discharge resistance. In relation to this, instead of excluding an oil separation device from inside of a casing, a method of increasing an oil separation effect by extending a refrigerant discharge pipe toward a compression part or a driving motor is provided.

However, when a refrigerant discharge pipe extends toward a driving motor like the compressor in the related art, an oil separation effect in an oil separation space belonging to an inner space of a casing may be increased by delaying refrigerant discharge. However, since a space between a lower end of the refrigerant discharge pipe and an upper end of the driving motor is very small, backflow or overflow of sealed oil may occur, That is, when a speed of sealing oil through a refrigerant discharge pipe is higher than a moving speed of oil moving into a lower space of a casing through a driving motor, the oil sealed through the refrigerant discharge pipe may not pass through the driving motor, and may be stagnant between the driving motor and the refrigerant discharge pipe. Then, as the upper space of the stagnant oil is sealed, an oil backflow phenomenon or an oil overflow phenomenon in which the oil is pushed into the refrigerant discharge pipe may be caused. Thus, as oil sealing time is delayed, a whole time of manufacturing the compressor is increased, thereby raising a manufacture cost.

In addition, when oil is sealed using a refrigerant discharge pipe like the compressor in the related art, in consideration of the stagnant oil described above, a clearance between a casing and a driving motor and/or a clearance provided in-between of a stator coil may be enlarged to suppress oil from being stagnant. However, in this case, in correspondence with an increase in a clearance between a casing and a driving motor and/or a clearance provided in-between of a stator coil, a flux path area of a stator or a number of winding wires of the stator coil (a coil diameter) is reduced, thereby deteriorating motor efficiency.

SUMMARY

Therefore, to obviate those problems, an aspect of the detailed description is to provide a compressor capable of, when oil is sealed into a refrigerant discharge pipe, suppressing the sealed oil from flowing back or overflowing through the refrigerant discharge pipe even when an inlet of the refrigerant discharge pipe is blocked.

Further, an aspect of the detailed description is to provide a compressor capable of, when oil is sealed, suppressing the oil from flowing back or overflowing through a refrigerant discharge pipe by inserting the refrigerant discharge pipe deep into an upper space of a casing, without having to install an oil separation device inside and/or outside the casing.

Still further, an aspect of the detailed description is to provide a compressor capable of ensuring both a flux path area of a stator and a number of winding wires of a stator coil or a coil diameter and, when oil is sealed, suppressing the oil from flowing back or overflowing through a refrigerant discharge pipe.

Another aspect of the detailed description is to provide a compressor capable of, when oil is sealed through a refrigerant discharge pipe, suppressing the oil from flowing back or overflowing through a refrigerant discharge pipe and, during operation of the compressor, suppressing excessive leak of oil through the refrigerant discharge pipe.

Further, another aspect of the detailed description is to provide a compressor such that a structure of suppressing oil leak is simplified to reduce a manufacture cost of the compressor and, when oil is sealed through a refrigerant discharge pipe, backflow or overflow of the oil through the refrigerant discharge pipe is effectively suppressed.

Still further, another aspect of the detailed description is to provide a compressor including a refrigerant discharge pipe further provided with a separate path in addition to an inlet such that the compressor may effectively suppress oil backflow or overflow which may occur during oil sealing and also suppress oil leak through the path during operation of the compressor.

To achieve these and other advantages and in accordance with the purpose of the present disclosure, as embodied and broadly described herein, there is provided a scroll compressor that may include a further including: a sealed casing, a driving motor, a compression part, a rotating shaft, and a refrigerant discharge pipe. The motor unit may be disposed in an inner space of the casing. The compression part may be disposed in an inner space of the casing, and compress refrigerant. The rotating shaft may connect the driving motor to the compression part to transmit driving force of the driving motor to the compression part. The refrigerant discharge pipe may include an inlet and an outlet at both ends and be coupled through the casing, the inlet communicating with the inner space of the casing to be apart from an upper end of the driving motor by a preset space, The refrigerant discharge pipe may be provided with a communication hole between the inlet and the outlet to penetrate between an outer circumferential surface and an inner circumferential surface of the refrigerant discharge pipe. Thus, during oil sealing through the refrigerant discharge pipe, a flux path area of a driving motor may be ensured, and a number of winding wires and/or a coil diameter of a stator coil may be ensured. Thus, efficiency of the driving motor may be maintained and backflow or overflow of oil through the refrigerant discharge pipe may be suppressed. In addition, during operation of the compressor, oil may be suppressed from being excessively leaked through the refrigerant discharge pipe without having to include a separate oil separator inside or inside the casing.

As an example, the communication hole may be provided in a position apart from the inlet of the refrigerant discharge pipe by a preset space. Accordingly, even when the inlet of the refrigerant discharge pipe is blocked by oil stagnant in the upper space of the casing, the upper space of the casing may communicate with the refrigerant discharge pipe through a communication hole to block sealing of the upper space. Accordingly, backflow or overflow of oil that may be caused by the sealing of the upper space may be suppressed.

In detail, the communication hole may be provided in a circular sectional shape. Thus, the communication hole may be easily formed, thereby reducing a manufacture cost.

In detail, the communication hole may be provided to have a non-circular sectional shape extending to elongate in a longitudinal direction. By doing so, an opening area of an upper portion of the communication hole may be relatively reduced, and thus, oil that has not been separated from refrigerant during normal operation of the compressor may be suppressed from being leaked through the communication hole.

As another example, the communication hole may extend from the inlet of the refrigerant discharge pipe to a preset height. Thus, on condition that a total opening area of the communication hole is same, when an opening area of an upper portion of the communication hole is reduced, oil leak through the communication hole may be suppressed during normal operation of the compressor.

In detail, the communication hole may be provided to have a sectional area decreasing in a direction from the inlet of refrigerant discharge pipe toward the outlet of the refrigerant discharge pipe. By doing so, an opening area in an upper portion of the communication hole may be reduced, and oil leak through the communication hole may be effectively suppressed during normal operation of the compressor.

As another example, with respect to the communication hole, a plurality of communication holes may be provided to have a preset space therebetween along a circumferential direction of the refrigerant discharge pipe. The plurality of communication holes may be provided to have a same sectional area and/or a same space therebetween along a circumferential direction. Accordingly, the communication hole may be easily formed, and when the inlet of the communication hole is blocked by oil, the pressure (air) in the upper space may evenly and quickly flow out to effectively suppress backflow or overflow of the sealed oil.

As another example, an entire opening area of the communication hole may be larger than or same as an inlet area of the refrigerant discharge pipe. Thus, when the inlet of the communication hole may be blocked by oil during oil sealing, the pressure (air) in the upper space may evenly and quickly flow out to effectively suppress backflow or overflow of the sealed oil.

As another example, an entire area of the communication hole may be less than an inlet area of the refrigerant discharge pipe. By doing so, the oil may be suppressed from not being separated from refrigerant during normal operation of the compressor and leaked to outside the compressor through the communication hole.

As another example, a distance from the inlet of the refrigerant discharge pipe to an upper end of the communication hole may be less than half of a length of the refrigerant discharge pipe accommodated in the inner space of the casing. By doing so, during oil sealing, backflow or overflow of the sealed oil through the refrigerant discharge pipe may be suppressed, and during normal operation, excessive leak of oil that has not been separated from refrigerant through the refrigerant discharge pipe may be suppressed.

As another example, a distance from the inlet of the refrigerant discharge pipe to an upper end of the communication hole may be greater than or equal to 0.2 or 0.3 times a value obtained by dividing a total amount ($\ell$) of oil sealed into the inner space of the casing by a cross-sectional area of the casing. Thus, leak of oil with refrigerant may be suppressed and, during oil sealing, backflow or overflow of the sealed oil through the communication hole may be effectively suppressed by properly limiting an insertion depth of the refrigerant discharge pipe without having to include a separate oil separator.

As another example, an oil blocking portion surrounding the refrigerant discharge pipe to be apart from the refrigerant discharge pipe by a preset distance may be provided in an outer circumferential portion of the refrigerant discharge pipe. Thus, during oil sealing, backflow or overflow of the sealed oil through the communication hole may be effectively suppressed. In addition, as an oil separator having a simple structure is provided in the casing, oil may be smoothly sealed through the refrigerant discharge pipe during oil sealing, and effectively suppressed from being leaked through the communication hole during normal operation.

In detail, the oil blocking portion may at least partially overlap the communication hole of the refrigerant discharge pipe in a radial direction of the rotating shaft. By doing so, oil that has not been separated from refrigerant during normal operation due to blocking of the communication hole by the oil blocking portion may be suppressed from being leaked through the communication hole.

In detail, a distance between a lower end of the oil blocking portion and an upper end of the driving motor facing the lower end of the oil blocking portion in an axial direction of the rotating shaft may be longer than or equal to a distance from the inlet of the refrigerant discharge pipe and an upper end of the driving motor facing the inlet of the refrigerant discharge pipe in an axial direction of the rotating shaft. Thus, when the inlet of the refrigerant discharge pipe is blocked, blocking of the communication hole by the oil blocking portion may be prevented. Then, the oil blocking portion may be provided on an outer circumference of the refrigerant discharge pipe, and pressure in the upper space may smoothly flow out through a space between the oil blocking portion and the refrigerant discharge pipe and through the communication hole.

As another example, the compression part includes: an orbiting scroll coupled to the rotating shaft and configured to perform an orbiting motion, and a non-orbiting scroll engaged with the orbiting scroll to define a compression chamber. An insertion depth of the refrigerant discharge pipe may be provided to be greater than half of a distance between the upper end of the rotating shaft and an inner circumferential surface of the casing facing the upper end of the rotation shaft. Thus, in a bottom-compression type scroll compressor in which a compression part is located below a driving motor, leak of oil that has not been separated from refrigerant in an inner space of a casing to outside of the casing may be effectively suppressed without having to include a complicated oil separator inside or inside the casing.

Specifically, the refrigerant discharge pipe may be provided to have an inlet area equal to an outlet area. By doing so, a structure of the refrigerant discharge pipe may be simplified in the bottom-compression type scroll compressor to thereby reduce a manufacture cost. In addition, the oil may be smoothly sealed during oil sealing and leak of oil with refrigerant may be suppressed during normal operation of the bottom-compression type scroll compressor.

As another example, the compression part may include a cylinder, a roller inserted into the cylinder and included in the rotating shaft to rotate, and a vane slidably inserted into one of the cylinder and the roller. An insertion depth of the refrigerant discharge pipe may be provided to be greater than half of a distance between the upper end of the rotating shaft and an inner circumferential surface of the casing facing the upper end of the rotation shaft. Thus, in a bottom-compression type rotary compressor in which a compression part is located below a driving motor, leak of oil that has not been separated from refrigerant in an inner space of a casing to outside of the casing may be effectively suppressed without having to include a complicated oil separator inside or inside the casing.

Specifically, the refrigerant discharge pipe may be provided to have an inlet area equal to an outlet area. By doing so, a structure of the refrigerant discharge pipe may be simplified in the bottom-compression type rotary compressor to thereby reduce a manufacture cost. In addition, the oil may be smoothly sealed during oil sealing and leak of oil with refrigerant may be suppressed during normal operation of the bottom-compression type rotary compressor.

DETAILED DESCRIPTION

Description will now be given in detail of a compressor disclosed herein, with reference to the accompanying drawings. In the following description, a description of some components may be omitted to clarify features of the present disclosure.

In addition, the term "upper side" used in the following description refers to a direction away from a support surface for supporting a scroll compressor according to an implementation of the present disclosure, that is, a direction toward a driving unit (motor part or driving motor) when viewed based on the driving unit (motor part or driving motor) and a compression part. The term "lower side" refers to a direction toward the support surface, that is, a direction toward the compression part when viewed based on the driving unit (motor part or driving motor) and the compression part.

The term "axial direction" used in the following description refers to a lengthwise (longitudinal) direction of a rotating shaft. The "axial direction" may be understood as an up and down (or vertical) direction. The term "radial direction" refers to a direction that intersects the rotating shaft.

In addition, hereinafter, a bottom compression type and high pressure type compressor in which a refrigerant suction pipe constituting a suction passage is directly connected to a compression part and a refrigerant discharge pipe communicates with an inner space of a casing so that the inner space of the casing provides discharge pressure is described as an example.

In addition, hereinafter, a scroll compressor is described as an example. However, the description herein may also apply to a case when a refrigerant discharge pipe is connected to an upper end of a casing, like a rotary compressor.

Figure 1:
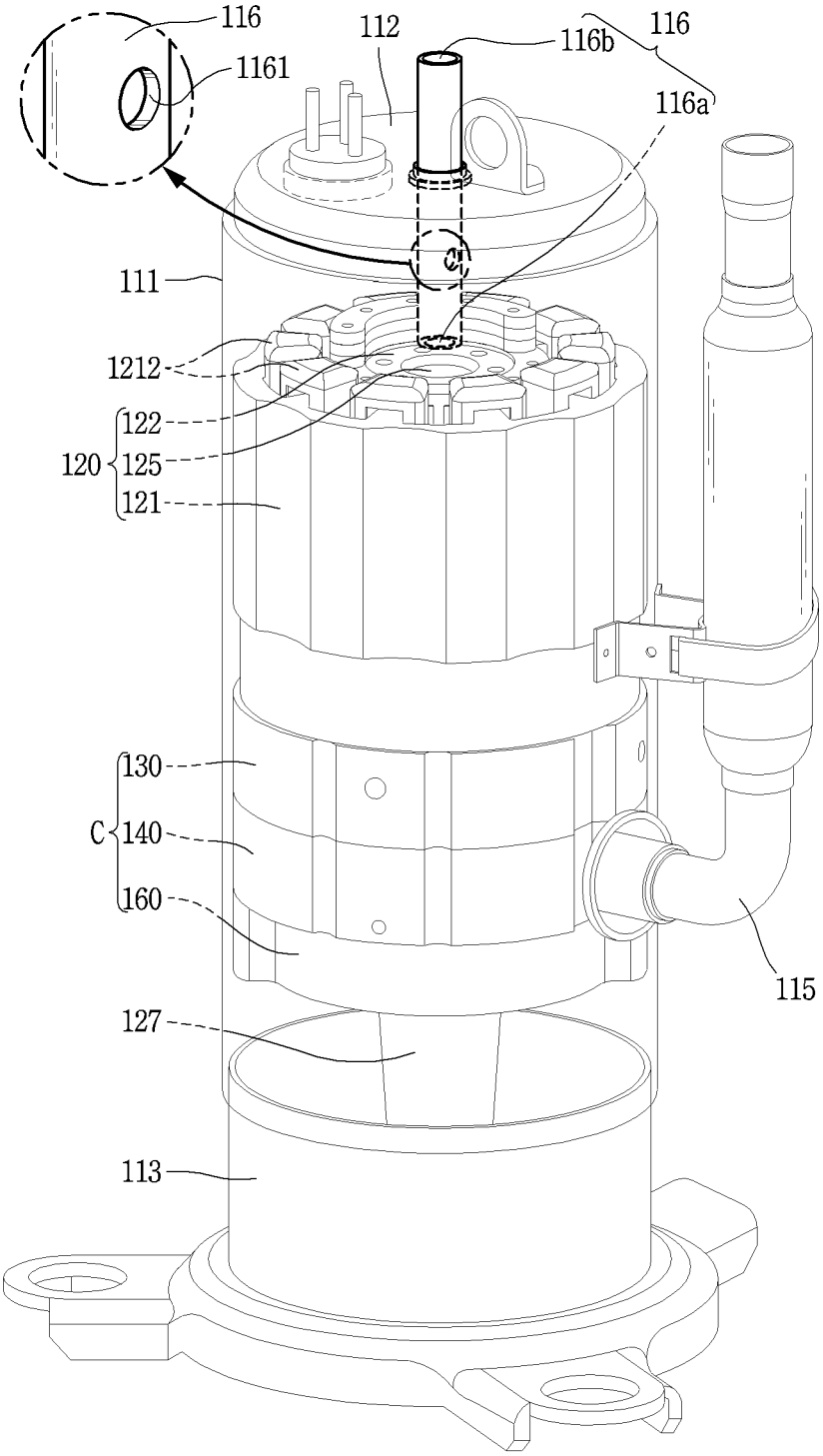
FIG. 1 is a perspective view illustrating an inner structure of a scroll compressor including a temperature detection unit in accordance with this implementation.
Figure 2:
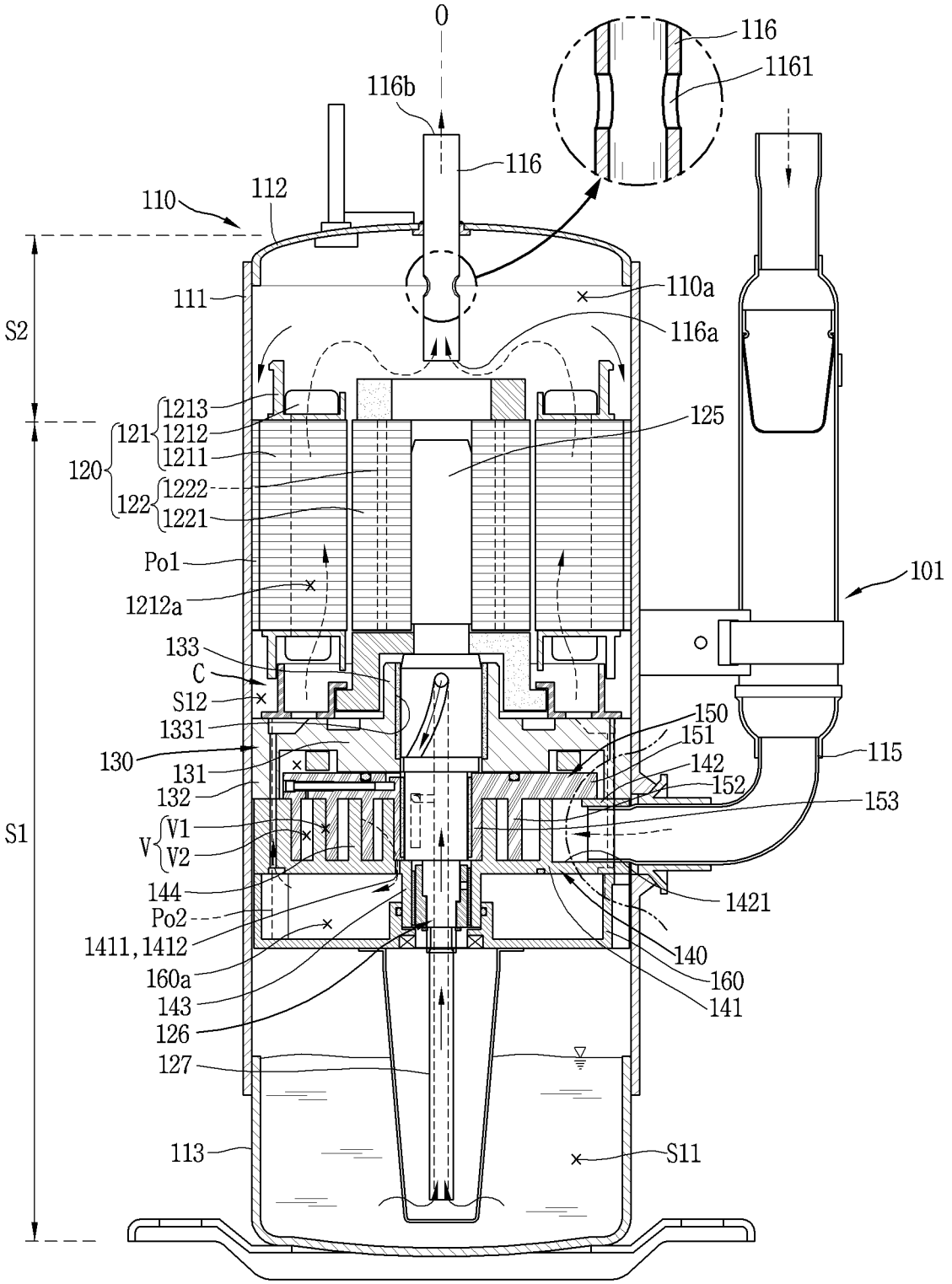
FIG. 2 is a longitudinal sectional view of a bottom-compression type scroll compressor in accordance with this implementation.

FIG. 1 is a perspective view illustrating an inner structure of a scroll compressor including a temperature detection unit in accordance with this implementation. FIG. 2 is a longitudinal sectional view of a bottom-compression type scroll compressor in accordance with this implementation.

Referring to FIGS. 1 and 2, a high-pressure and bottom-compression type scroll compressor (hereinafter, referred to as a scroll compressor) according to this implementation includes a driving motor 120 constituting a motor part disposed in an upper portion of a casing 110, and a main frame 130, a fixed scroll 140, an orbiting scroll 150, and a discharge cover 160 each disposed below the driving motor 120. In general, the driving motor 120 may constitute the motor part as described above, and the main frame 130, the fixed scroll 140, the orbiting scroll 150, and the discharge cover 160 may constitute a compression part C.

The driving motor 120 constituting the motor part is coupled to an upper end of a rotating shaft 125 to be described later, and the compression part C is coupled to a lower end of the rotating shaft 125. Accordingly, a compressor 10 constitutes the bottom-compression type structure described above, and the compression part C is connected to the driving motor 120 by the rotating shaft 125 to operate according to rotational force of the driving motor 120. Thus, the driving motor 120 may be understood as a driving unit configured to drive the compression part C. Hereinafter, a driving motor may be also referred as a motor part or a driving unit.

Referring to FIGS. 1 and 2, the casing 110 according to the implementation may include a cylindrical shell 111, an upper shell 112, and a lower shell 113. The cylindrical shell 112 may be formed in a cylindrical shape with upper and lower ends open. The upper shell 112 may be coupled to cover the open upper end of the cylindrical shell 111. The lower shell 113 may be coupled to cover the open lower end of the cylindrical shell 111. Accordingly, the inner space 110*a* of the casing 110 may be sealed. The sealed inner space 110*a* of the casing 110 may be divided into a lower space S1 and an upper space S2 based on the driving motor 120.

The lower space S1 may be a space defined below the driving motor 120. The lower space S1 may be further divided into an oil storage space S11 and an outflow passage S12 with the compression part C therebetween.

The upper space S2 may be a space defined above the driving motor 120 to form an oil separating space in which oil is separated from refrigerant discharged from the compression part C. The upper space S2 communicates with a refrigerant discharge pipe 116 which will be described later.

The driving motor 120 and the main frame 130 may be fixedly inserted into the cylindrical shell 111. An outer circumferential surface of the driving motor 120 and an outer circumferential surface of the main frame 130 may be respectively provided with an oil return passage spaced apart from an inner circumferential surface of the cylindrical shell 111 by a predetermined distance.

A refrigerant suction pipe 115 is coupled through a side surface of the cylindrical shell 111. Accordingly, the refrigerant suction pipe 115 is coupled through the cylindrical shell 111 forming the casing 110 in a radial direction.

An inner end of the refrigerant discharge pipe 116 may be coupled through an upper portion of the upper shell 112 to communicate with the inner space 110*a* of the casing 110, specifically, the upper space S2 defined above the driving motor 120. Accordingly, the inner end of the refrigerant discharge pipe 116 constitutes an inlet 116*a*, and an outer end of the refrigerant discharge pipe 116 constitutes an outlet 116*b*.

Referring to FIGS. 1 and 2, the refrigerant discharge pipe 116 according to this implementation may be coupled through a center of the upper shell 112 in an axial direction of the rotating shaft 125 (hereinafter referred to as an axial direction) to be located on a same axial line as that of a center of the upper shell 112, i.e., an axial center O of the rotating shaft 125 which will be described later. Accordingly, the inlet 116*a* of the refrigerant discharge pipe 116 may be spaced apart from an upper end of the rotating shaft 125 by a preset distance. This will be described later again together with a communication hole 1161.

One end portion of an oil circulation pipe may be coupled through a lower half portion of the lower shell 113. Both ends of the oil circulation pipe may be open, and another end of the oil circulation pipe may be coupled through the refrigerant suction pipe 115. An oil circulation valve may be installed in a middle portion of the oil circulation pipe.

Referring to FIGS. 1 and 2, the driving motor 120 according to this implementation may include a stator 121 and a rotor 122. The stator 121 is fixedly inserted into the inner circumferential surface of the cylindrical shell 111, and the rotor 122 is rotatably disposed in the stator 121.

The stator 121 includes a stator core 1211 and a stator coil 1212.

The stator core 1211 is formed in an annular shape or a hollow cylindrical shape and is shrink-fitted onto the inner circumferential surface of the cylindrical shell 111. A first oil return passage Po1 is arranged on an outer circumferential surface of the stator core 1211 to be spaced apart from an inner circumferential surface of the cylindrical shell 111. The first oil return passage Po1 communicates with a second oil return passage Po2 of a compression part C which is to be described later. Accordingly, oil sealed into the upper space S2 or oil separated from refrigerant in the upper space S2 is returned to the oil storage space S11 of the casing 110 through the first oil return passage Po1 and the second oil return passage Po2.

The stator coil 1212 is provided to have a preset wire diameter, and wound around the stator core 1211 in correspondence with a preset number of winding wires. A coil clearance 1212*a* is provided in-between of the stator coil 1212, i.e., in a bundle of the stator coil 1212, The coil clearance 1212*a* provides an inner passage together with a gap between the stator 121 and the rotor 122. The inner passage may constitute an oil return passage or a refrigerant discharge passage. Particularly, when a compressor is assembled, i.e., when oil is sealed, the inner passage functions as a part of the first oil return passage Po1. Accordingly, hereinafter, it may be understood that the oil return passage Po1 includes an internal passage including a clearance provided in-between of the stator coil 1212 and a clearance between the stator 121 and the rotor 122, in addition to the passage between the casing 110 and the stator 121 described above.

An insulator 1213 is an insulating member, and inserted between the stator core 1211 and the stator coil 1212. The insulator 1213 extends from both upper and lower ends of the stator core 1211 in an axial direction. For example, the insulator 1213 may extend to a position higher than that of the inlet 116*a* of the refrigerant discharge pipe 116, i.e., closer to an inner circumferential surface of the upper shell 112. Thus, as refrigerant in the upper space S2 avoids the insulator 1213 and is guided toward the inlet 116*a* of the refrigerant discharge pipe 116, a discharge distance of the refrigerant may be further extended to enhance an oil separation effect.

The rotor 122 may include a rotor core 1221 and permanent magnets 1222.

The rotor core 1221 is formed in a cylindrical shape to be accommodated in a rotor accommodating portion 1211*a* defined in the central portion of the stator core 1211.

Specifically, the rotor core 1221 may be rotatably inserted into the rotor accommodating portion 1211*a* of the stator core 1211 with a predetermined gap therebetween. The permanent magnets 1222 may be embedded in the rotor core 1221 at preset intervals along the circumferential direction.

A balance weight 123 may be coupled to a lower end of the rotor core 1221. Alternatively, the balance weight 123 may be coupled to the rotating shaft. This implementation will be described based on an example in which the balance weight 123 is coupled to the rotating shaft 125. The balance weight 123 may be disposed on each of a lower end side and an upper end side of the rotor, and the two balance weights 123 may be installed symmetrically to each other.

The rotating shaft 125 is coupled to the center of the rotor core 1221. An upper end portion of the rotating shaft 125 is press-fitted to the rotor 122, and a lower end portion of the rotating shaft 125 is rotatably inserted into the main frame 130 to be supported in the radial direction.

The main frame 130 is provided with a main bearing 171 configured as a bush bearing to support the lower end portion of the rotating shaft 125. Accordingly, a portion, which is inserted into the main frame 130, of the lower end portion of the rotating shaft 125 may smoothly rotate inside the main frame 130.

The rotating shaft 125 may transfer a rotational force of the driving motor 120 to an orbiting scroll 150 constituting the compression part C. Accordingly, the orbiting scroll 150 eccentrically coupled to the rotating shaft 125 may perform an orbiting motion with respect to the fixed scroll 140.

An oil supply passage 126 is provided to have a hollow shape in the rotating shaft 125. The oil supply passage 126 extends from a lower end to a middle height of the rotating shaft 125, e.g., to a main bearing portion 133 that is to be described later. Accordingly, the oil supply passage 126 may have a shape closed from a middle portion to an upper portion of the rotating shaft 125 to enable to supply oil to a sliding unit using differential pressure.

An oil pickup 127 configured to pump oil filled in the oil storage space S11 may be coupled to a lower end of the rotating shaft 125. Accordingly, during rotation of the rotating shaft 125, the oil filled in the oil storage space S11 is sucked into an upper end of the rotating shaft 125 through the oil pickup 127 and the oil supply passage 126 to lubricate a sliding unit.

Referring to FIGS. 1 and 2, the compression part C according to this implementation includes the main frame 130, the fixed scroll 140, and the orbiting scroll 150. The second oil return passage Po2 communicating with the first oil return passage Po1 described above is provided in an outer circumferential surface of the compression part C to be spaced apart from an inner circumferential surface of the casing 110. Accordingly, oil sealed into the upper space S2 or oil separated from refrigerant in the upper space S2 is returned to the oil storage space S11 of the casing 110 through the first oil return passage Po1 and the second oil return passage Po2.

The main frame 130 may include a frame end plate 131, a frame side wall 132, and a main bearing portion 133. The frame end plate 131 is installed below the driving motor 120. A main bearing hole 1331 constituting the main bearing portion 133 to be described later may be formed through a center portion of the frame end plate 131 in an axial direction. The frame side wall 132 may extend in a cylindrical shape from an edge of a lower side surface of the frame end plate 131, and be fixed to the inner circumferential surface of the cylindrical shell 111 by performing shrink-fitting or welding. The main bearing portion 133 includes a main bearing hole 1331 through which the rotating shaft 125 is rotatably inserted to support the rotating shaft 125 in the radial direction.

The fixed scroll 140 includes a fixed end plate 141, a fixed side wall 142, a sub bearing portion 143, and a fixed wrap 144.

The fixed end plate 141 is provided in a disk shape and arranged below the frame end plate 131 with a preset space therebetween. A main bearing hole 1431 constituting the sub bearing unit 143 is formed through a center portion of the frame end plate 141 in a longitudinal direction. A first discharge port 1411 and a second discharge port 1412 are provided around the sub bearing hole 1431. The first and second discharge ports 1411 and 1412 communicate with a first compression chamber V1 and a second compression chamber V2, respectively, such that compressed refrigerant is discharged into a muffler space 160*a* of the discharge cover 160.

The first discharge port 1411 and the second discharge port 1412 are provided in a position eccentric from a center of the fixed end plate 141. In other words, as the sub bearing hole 1431 is provided through the center of the fixed end plate 141, the first discharge hole 1411 and the second discharge hole 1412 are arranged in positions eccentric from the sub bearing hole 1431. The first discharge hole 1411 and the second discharge hole 1412 will be described later, together with a refrigerant accommodating groove 1444.

The fixed side wall 142 extends from an edge of an upper surface of the fixed end plate 141 in a longitudinal direction to be coupled to the frame side wall 132 of the main frame 130. The fixed side wall 142 is provided with a suction port 1421 formed through the fixed side wall 142 in the radial direction. As aforementioned, an end portion of the refrigerant suction pipe 115 inserted through the cylindrical shell 111 may be inserted into the suction port 1421.

The sub bearing hole 1431 having a cylindrical shape may be formed through a center of the sub bearing portion 143 in the axial direction to radially support a lower end of the rotating shaft 125.

A fixed wrap 144 may extend from the upper surface of the fixed end plate 141 toward the orbiting scroll 150 in the axial direction. The fixed wrap 144 is engaged with an orbiting wrap 152 which is to be described later, to define the compression chamber V. The compression chamber V includes the first compression chamber V1 defined between an inner surface of the fixed wrap 144 and an outer surface of the orbiting wrap 152, and the second compression chamber V2 defined between an outer surface of the fixed wrap 144 and an inner surface of the orbiting wrap 152.

The fixing wrap 144 may be formed in an involute shape. However, the fixed wrap 144 and the orbiting wrap 152 may be formed in various shapes other than the involute shape. For example, the fixed wrap 144 may be formed in an approximately elliptical shape in which a plurality of arcs having different diameters and origins are connected and an outermost curve has a major axis and a minor axis. The orbiting wrap 152 may also be formed in a similar manner.

The orbiting scroll 150 includes an orbiting end plate 151, the orbiting wrap 152, and a rotating shaft coupling portion 153.

The orbiting end plate 151 is provided in a disk shape and accommodated between the frame end plate 131 and the fixed end plate 141. An upper surface of the orbiting end plate 151 may be supported in the axial direction by the main frame 130 with interposing a back pressure sealing member therebetween.

The orbiting wrap 152 extends from a lower surface of the orbiting end plate 151 toward the fixed end plate 141, and is engaged with the fixed wrap 144 to define the first pressure chamber V1 and the second pressure chamber V2, both described above.

Since the orbiting wrap 152 has a shape corresponding to the shape of the fixed wrap 144 described above, a description of the orbiting wrap 152 will be replaced with the description of the fixed wrap 144. However, an inner end portion of the orbiting wrap 152 is provided in a central portion of the orbiting end plate 151, and the rotating shaft coupling portion 153 may be inserted through the central portion of the orbiting end plate 151 in the axial direction. Accordingly, as described above, the first discharge port 1411 and the second discharge port 1412 are provided in a position eccentric from a center of the orbiting scroll 150, i.e., the rotating shaft coupling portion 153.

The rotating shaft 125 may be rotatably coupled into the rotating shaft coupling portion 153. An outer circumferential part of the rotating shaft coupling portion 153 is connected to the orbiting wrap 152 to define the first compression chamber V1 together with the fixed wrap 144 during a compression process.

The rotating shaft coupling portion 153 may be formed at a height at which it overlaps the orbiting wrap 152 on the same plane. That is, the rotating shaft coupling portion 153 is disposed at a height at which an eccentric portion 1251 of the rotating shaft 125 overlaps the orbiting wrap 152 on the same plane. Accordingly, repulsive force and compressive force of refrigerant can cancel each other while being applied to the same plane based on the orbiting end plate 151, and thus inclination of the orbiting scroll 150 due to interaction between the compressive force and the repulsive force can be suppressed.

In the drawings, a reference numeral 170 denotes an Oldham ring.

The scroll compressor according to the implementation of the present disclosure may operate as follows.

That is, when power is applied to the driving motor 120, rotational force is generated and the rotor 122 and the rotating shaft 125 rotates accordingly. As the rotating shaft 125 rotates, the orbiting scroll 150 eccentrically coupled to the rotating shaft 125 performs an orbiting motion relative to the fixed scroll 140 by the Oldham ring 170.

Then, volumes of the first pressure chamber V1 and the second pressure chamber V2 gradually decrease in a direction from an outer portion toward a central portion of each of the first and second pressure chambers V1 and V2. Then, refrigerant is sucked into the first and second pressure chambers V1 and V2 through the refrigerant suction pipe 115.

Then, the refrigerant is compressed while moving along a movement trajectory of each of the first and second compression chambers V1 and V2. The compressed refrigerant is discharged into the muffler space 160*a* of the discharge cover 160 through the first and second discharge ports 1411 and 1412 communicating with the first and second compression chambers V1 and V2, respectively.

Then, this refrigerant flows out into an outflow passage S12 between the main frame 130 and the driving motor 120 through outflow holes in the fixed scroll 140 and the main frame 130. The refrigerant passes through the driving motor 120 to move to the upper space S2 of the casing 110 defined above the driving motor 120. Then, the refrigerant flows out of the compressor through the refrigerant discharge pipe 116, and then, is sucked into the compressor through the refrigerant suction pipe 115 via a condenser, an expander, and an evaporator. This series of circulating process may be repeatedly performed.

In this case, a certain amount of oil is mixed in refrigerant discharged from the compression chamber V. This oil moves to the upper space S2 together with the refrigerant and is separated from the refrigerant in the upper space S2, and then, returned to the lower space S1 of the casing 110, i.e., the oil storage space S11.

During assembly of the compressor, the oil described above is sealed into an inner space 110*a* (accurately, an upper space) of the casing 110 through the refrigerant discharge pipe 116. However, when the refrigerant discharge pipe 116 is inserted deep into the upper space S2 of the casing 110, compared to a speed of sealing oil through the refrigerant discharge pipe 116, a moving speed of the sealed oil passing through the driving motor 120 may be lower. Then, a part of the sealed oil may be stagnant in the upper space S2, and thus, an inlet of the refrigerant discharge pipe 116 may be soaked into the sealed oil. Then, as the upper space S2 is sealed, oil stagnant in the upper space S2 may flow back or overflow through the refrigerant discharge pipe 116 due to pressure of the upper space S2. Thus, as oil sealing time is delayed, a manufacture process of the compressor may be delayed, and thus a manufacture cost of the compressor may be increased.

Accordingly, in this implementation, the communication hole 1161 may be added to the inlet 116*a* of the refrigerant discharge pipe 116. Thus, even when some oil is stagnant in the upper space S2, the oil may be suppressed from flowing back or overflow through the refrigerant discharge pipe 116 by leaking pressure (air) of the upper space S2.

Figure 3:
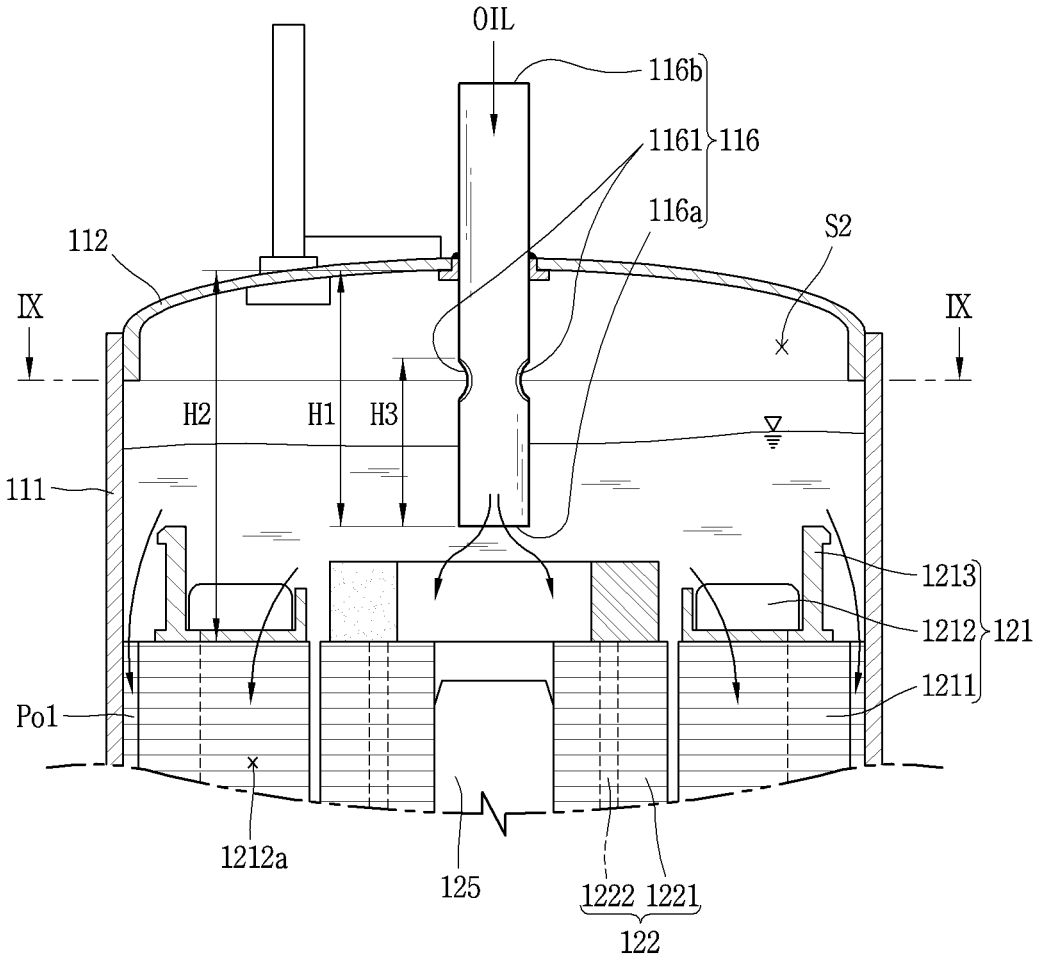
FIG. 3 is a sectional view illustrating a periphery of the refrigerant discharge pipe of FIG. 2.
Figure 4:
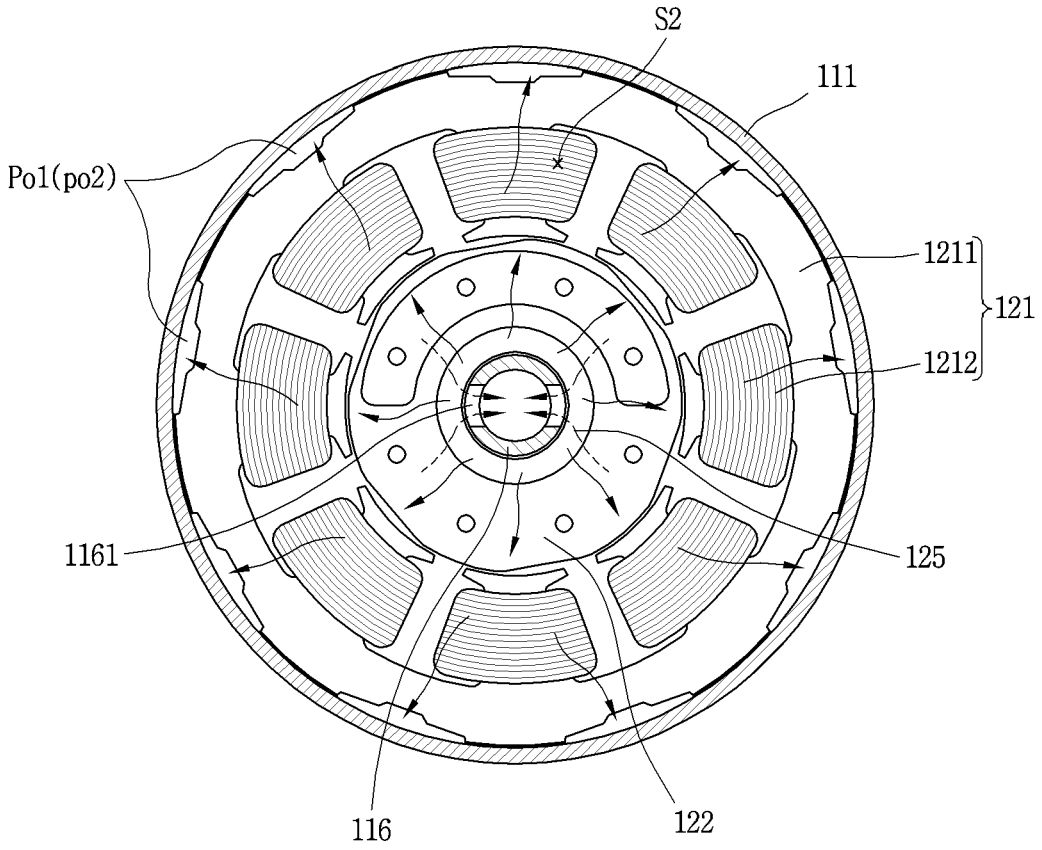
FIG. 4 is a cross-sectional view taken along line "IX-IX" of FIG. 3.
Figure 5:
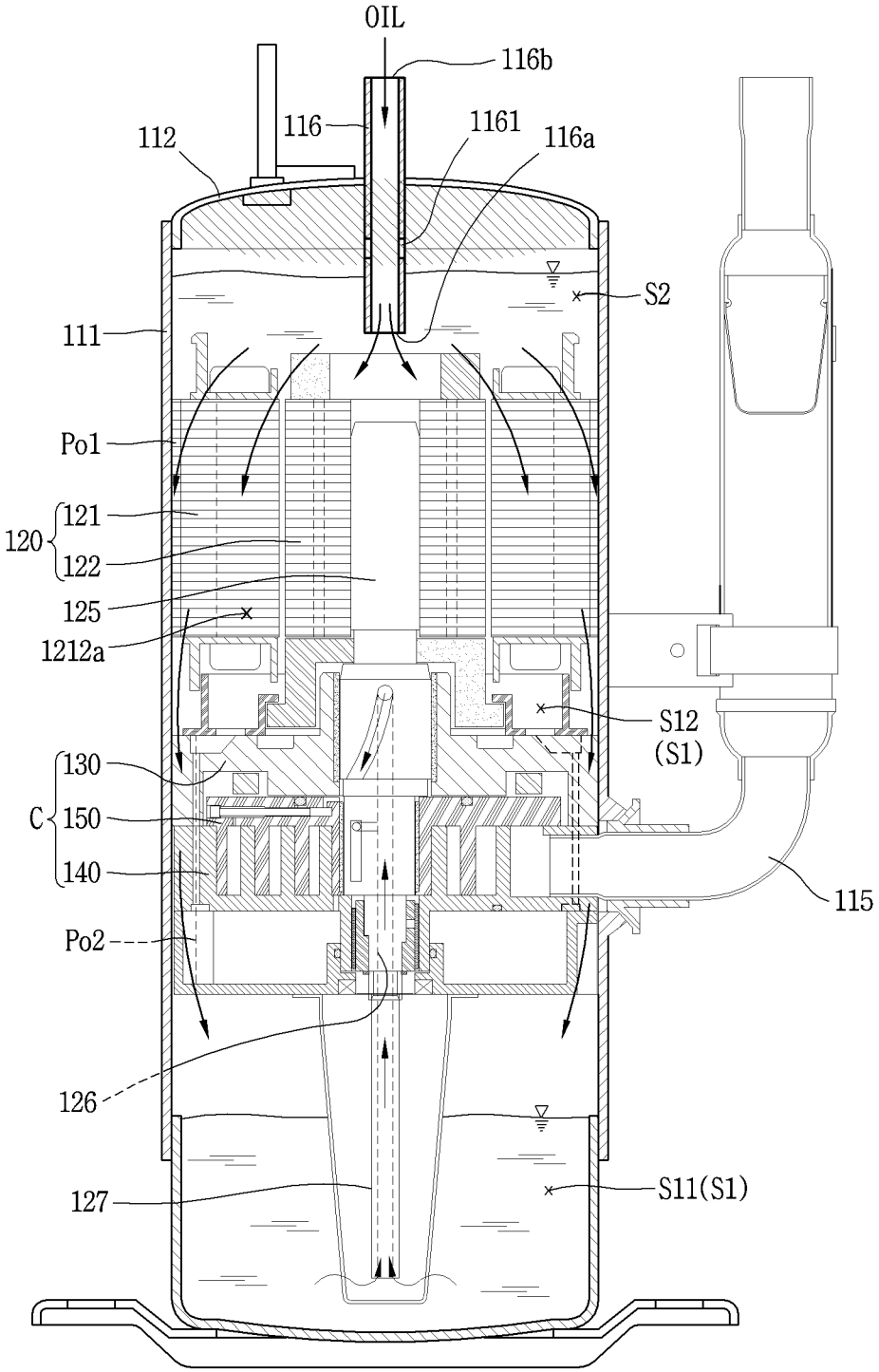
FIG. 5 is a longitudinal sectional view illustrating another implementation of a communication hole of FIG. 2.
Figure 6:
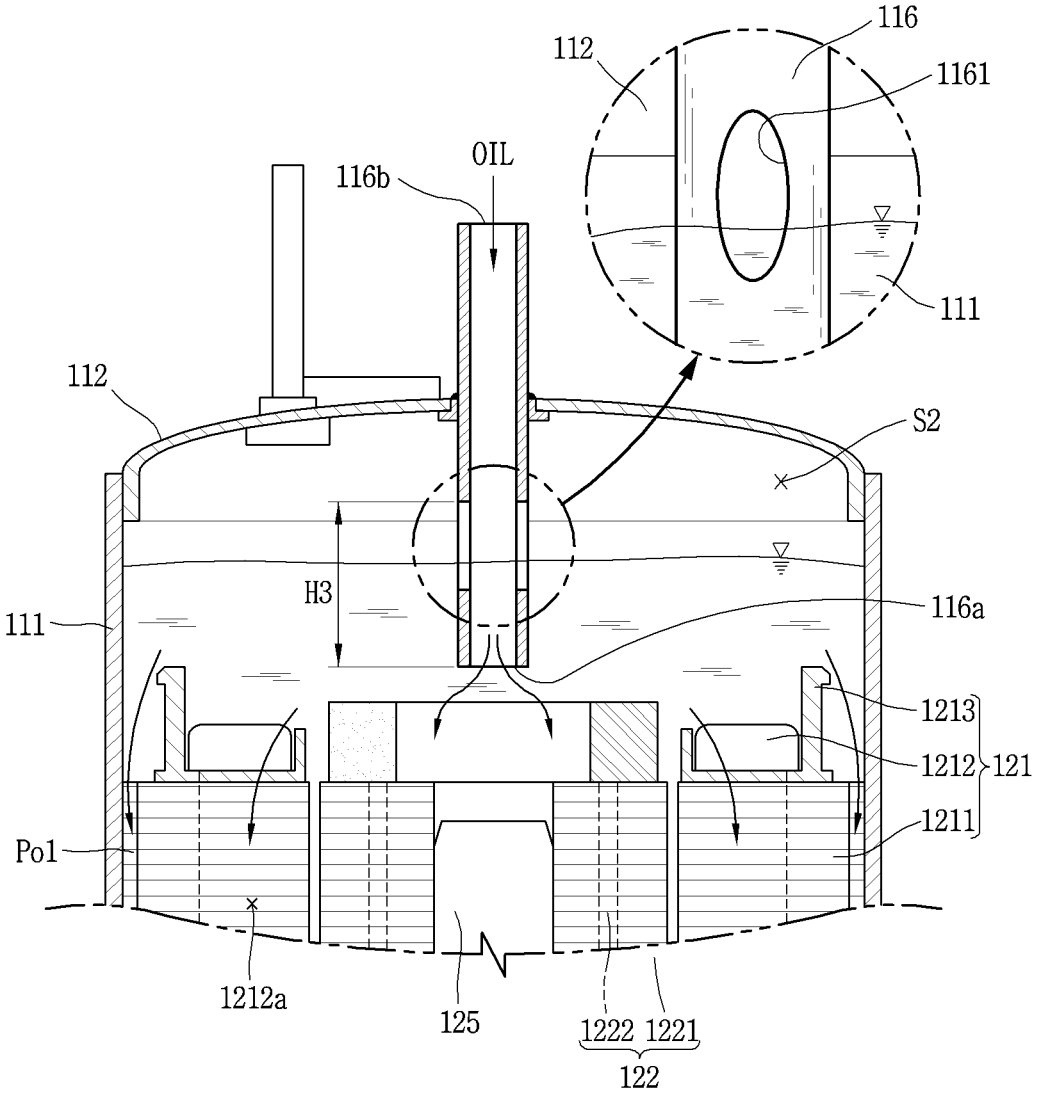
FIG. 6 is a longitudinal sectional view for explaining an oil sealing process in a scroll compressor to which the refrigerant discharge pipe is applied in accordance with this implementation.

FIG. 3 is a sectional view illustrating a periphery of the refrigerant discharge pipe of FIG. 2. FIG. 4 is a cross-sectional view taken along line "IX-IX" of FIG. 3. FIG. 5 is a longitudinal sectional view illustrating another implementation of a communication hole of FIG. 2. FIG. 6 is a longitudinal sectional view for explaining an oil sealing process of a scroll compressor to which the refrigerant discharge pipe is applied in accordance with this implementation.

Referring to FIGS. 3 and 4, the refrigerant discharge pipe 116 according to this implementation is inserted through the upper shell 112 constituting an upper surface of the casing 110 to communicate with the upper space S2. In other words, the inlet 116*a* of the refrigerant discharge pipe 116 communicates with the upper space S2 to be apart from an upper end of the driving motor 120 by a preset space. Accordingly, refrigerant moving to the upper space S2 flows into the inlet 116*a* of the refrigerant discharge pipe 116 through the space.

In detail, as described above, the refrigerant discharge pipe 116 is coupled through the upper shell 112, and an insertion depth H1 of the refrigerant discharge pipe 116 may be provided to be longer than half of a height H2 of the upper space S2. By doing so, a structure of the refrigerant discharge pipe 116 may be simplified and a refrigerant flow distance in the upper space S2 may be ensured to thereby minimize oil discharge.

Here, the insertion depth H1 of the refrigerant discharge pipe 116 may be defined as a length from an inner circumferential surface of the upper shell 112 to the inlet 116*a* of the refrigerant discharge pipe 116. The height H2 of the upper space S2 may be defined as an axial distance from an upper end of the rotor 122 or an upper end of the rotating shaft 125 to an inner circumferential surface of the upper shell 112 axially facing the upper end of the rotor 122 or the rotating shaft 125.

An inner diameter of the refrigerant discharge pipe 116 is provided to be same along a longitudinal direction of the refrigerant discharge pipe 116. In other words, the inlet 116*a* of the refrigerant discharge pipe 116 may be provided to have a same inner diameter as that of the outlet 116*b*. Accordingly, a structure of the refrigerant discharge pipe 116 may be simplified, and oil may be suppressed from flowing back or overflowing through the communication hole 1161 that is to be described later.

However, the inlet 116*a* of the refrigerant discharge pipe 116 may be provided to be different from the outlet 116*b* of the refrigerant discharge pipe 116. For example, an expanded tube portion may be provided in the inlet 116*a* of the refrigerant discharge pipe 116. Thus, when the refrigerant discharge pipe 116 extends to be adjacent to the driving motor 120, a delay in refrigerant discharge in the compressor due to an excessive increase in discharge resistance may be resolved. However, in this case, the communication hole 1161 may be provided in the expanded tube portion and/or the refrigerant discharge pipe 116. Hereinafter, an example in which the expanded tube portion is not present, i.e., the inner diameter of the inlet 116*a* is identical to that of the outlet 116*b* is described.

The inner diameter of the inlet 116*a* of the refrigerant discharge pipe 116 is provided to be smaller than an inner diameter of a refrigerant path of the driving motor 120, i.e., a gap between the stator 121 and the rotor 122. Thus, refrigerant moving to the upper space S2 through the refrigerant path of the driving motor 120 may not flow directly into the refrigerant discharge pipe 116 but circulate the upper space S2. Accordingly, an oil separation effect in which oil is separated from the refrigerant may be enhanced.

Referring to FIGS. 3 and 4, the communication hole 1161 is radially inserted through a middle portion of the refrigerant discharge pipe 116 according to this implementation, i.e., a circumferential surface of the refrigerant discharge pipe 116 included in the upper space S2. One communication hole 1161 may be provided. However, a plurality of communication holes 1161 may be provided with a preset space therebetween in a circumferential direction. Accordingly, during sealing of oil, even when the inlet 116*a* of the refrigerant discharge pipe 116 is blocked by oil stagnant in the upper space S2, pressure of the upper space S2 quickly flows out to suppress sealing of the upper space S2.

The plurality of communication holes 1161 may be provided and have a same diameter and/or a same sectional area. Thus, the communication hole 1161 may be easily machined. However, the plurality of communication holes 1161 may be provided to have different diameters and/or different sectional areas. An implementation in which the plurality of communication holes 1161 have different diameters and/or sectional areas will be described later.

The communication hole 1161 is provided to have an area larger than or same as an inlet area of the refrigerant discharge pipe 116. In other words, a whole opening area of the communication hole 1161 is provided to be larger than or same as an inlet area of the refrigerant discharge pipe 116. Accordingly, even when a part of the communication hole 1161 as well as the inlet 116*a* of the refrigerant discharge pipe 116 is blocked by being immersed in oil, pressure (air) of the upper space S2 may quickly flow out through the communication hole 1161 by ensuring an area of the communication hole 1161. Further, when a large opening area of the communication hole 1161 is provided, design freedom for a proper location of the communication hole 1161 may be enhanced to be generally applied to various conditions.

However, a whole opening area of the communication hole 1161 may be provided to be smaller than an inlet area of the refrigerant discharge pipe 116. In this case, backflow or overflow of oil may be effectively blocked during sealing of the oil, and simultaneously, leak of the oil through the communication hole 1161 during operation may be suppressed.

The communication hole 1161 is provided in a position spaced apart from the inlet 116*a* of the refrigerant discharge pipe 116 by a proper distance. In other words, the communication hole 1161 may be provided in a position such that the communication hole 1161 is not immersed in oil that may be stagnant in the upper space S2 during oil sealing and leak of oil that has not been separated from refrigerant in the upper space S2 through the communication hole 1161 may be minimized.

For example, referring to FIG. 3, a hole height H3 of the communication hole 1161 may be provided to be smaller than or same as half of the insertion height H1 of the refrigerant discharge pipe 116. In other words, the hole height H3 defined as a distance between the inlet 116*a* of the refrigerant discharge pipe 116 to an upper end of the communication hole 1161 may be provided to be smaller than or same as half of the insertion depth H1 defined as a length from an inner circumferential surface of the upper shell 112 to the inlet 116*a* of the refrigerant discharge pipe 116. By doing so, the communication hole 1161 may be ensured to have the hole height H3 from the driving motor 120 not to be immersed in oil that may be stagnant in the upper space S2 during oil sealing, and also have the insertion height H1 from the upper shell 112 such that leak of oil that has not been separated from refrigerant in the upper space S2 through the communication hole 1161 may be minimized.

A position of the communication hole 1161 may be determined in proportion to a value obtained by dividing an amount of sealed oil by a cross-sectional area of the casing 110. Generally, experimental results show that an amount ( ℓ ) of oil stagnant in the upper space S2 is about 20% to 30% of a total amount ( ℓ ) of sealed oil (or an amount of rectified and sealed oil). Accordingly, the hole height H3 defined as a distance from the inlet 116*a* of the refrigerant discharge pipe 116 to an upper end of the communication hole 1161 may be provided to be equal to or greater than 0.2 or 0.3 times a value obtained by dividing a total amount ( ℓ ) of oil sealed into the inner space 110*a* of the casing 110 by a cross-sectional area of the casing 110.

In this case, it may be desirable to provide a distance from the inlet 116*a* of the refrigerant discharge pipe 116 to the upper end of the communication hole 1161, i.e., the hole height H3 to be same as or smaller than 0.5 times a value obtained by dividing a total amount ( ℓ ) of oil sealed into the inner space 110*a* of the casing 110 by a cross-sectional area of the casing 110 to suppress the oil discharge described above.

The communication hole may be provided in a circular sectional shape like FIG. 3. Thus, the communication hole 1161 may be easily formed. However, the communication hole 1161 may be provided in a non-circular sectional shape. For example, the communication hole 1161 may be provided to have an elliptical section or a long hole (slit) section extending to elongate in an axial direction of the rotating shaft 125 or in a longitudinal direction of the refrigerant discharge pipe 116 like FIG. 5. Accordingly, the communication hole 1161 may have an axial length greater than a circumferential length. In this case, a sectional area of the communication hole 1161 may not be excessively enlarged, and backflow or overflow of oil may be also effectively suppressed.

In other words, when the communication hole 1161 extends to elongate in the axial direction of the rotating shaft 125 or in the longitudinal direction of the refrigerant discharge pipe 116, even when the sectional area of the communication hole 1161 is same or small, a longitudinal range of the communication hole 1161 may increase. Accordingly, during oil sealing, even when the inlet 116*a* of the refrigerant discharge pipe 116 is blocked, a section in which the refrigerant discharge pipe 116 may communicate with the upper space S2 is increased, backflow or overflow of oil may be suppressed. Meanwhile, a sectional area (an opening area) of the communication hole 1161 may be maintained or reduced, and thus, discharge of oil mixed in the refrigerant during operation of the compressor may be effectively suppressed.

Referring to FIG. 6, when oil is sealed through the refrigerant discharge pipe 116, the oil sealed into the upper space S2 of the casing 110 may be stagnant in an upper surface of a driving motor, i.e., the upper space S2 to block the inlet 116*a* of the refrigerant discharge pipe 116. Then, as described above, in the upper space S2, a space provided in an upper surface of oil stagnant is sealed. Thus, due to pressure (air) in the space (a remaining upper space), oil may flow back or overflow through a refrigerant discharge pipe.

However, like this implementation, as the communication hole 1161 is provided in a middle portion of the refrigerant discharge pipe 116, i.e., in a position higher than that of the stagnant oil, even when the inlet 116*a* of the refrigerant discharge pipe 116 is blocked, the upper space S2 (a remaining upper space) of the casing 110 may communicate with the refrigerant discharge pipe 116 through the communication hole 1161. Then, pressure (air) in the upper space S2 (the remaining upper space) quickly flows out through the communication hole 1161 and the refrigerant discharge pipe 116 to relieve pressure in the upper space S2 (the remaining upper space). Accordingly, even when the inlet 116*a* of the refrigerant discharge pipe 116 is blocked, oil may be suppressed from flowing back or overflowing into the refrigerant discharge pipe 116.

Further, as the refrigerant discharge pipe 116 is inserted deep into the upper space S2 of the casing 110, a moving distance of the refrigerant in the upper space S2 may increase during operation of the compressor. Accordingly, a structure of suppressing oil leak may be simplified, and as an oil separation effect in the upper space S2 is enhanced, excessive leak of oil through the refrigerant discharge pipe 116 may be suppressed.

In some implementations, the communication hole 1161 may be provided in multiple layers along a longitudinal direction. In this case, the multiple layers of the communication hole 1161 may have different sectional areas. For example, the communication hole 1161 may have a sectional area (an opening area) gradually decreasing in a direction from the inlet 116*a* to the outlet 116*b*. Accordingly, as described above, backflow or overflow of oil that may occur during oil sealing may be suppressed, and oil leak that may occur during operation of the compressor may be relatively reduced.

By doing so, a flux path area of the driving motor may be ensured, and a number of winding wires of a stator coil and/or a coil diameter may be ensured. Thus, efficiency of the driving motor may be maintained. Accordingly, when oil is sealed through a refrigerant discharge pipe, even when an inlet of the refrigerant discharge pipe is blocked by stagnant oil, the oil may be suppressed from flowing back or overflowing through the refrigerant discharge pipe.

In addition, as the refrigerant suction pipe is inserted to be adjacent to an upper end of the driving motor as possible, the oil moving to an upper space together with refrigerant may circulate in the upper space for a long distance, and thus, be separated from the refrigerant. Accordingly, during operation of the compressor, the oil may be suppressed from being excessively leaked through the refrigerant discharge pipe without having to include a separate oil separator inside or inside the casing.

Hereinafter, a description will be given of another implementation of a communication hole.

That is, in the implementations described above, a communication hole is provided in a middle portion of a refrigerant discharge pipe. However, in some cases, a communication hole may extend longitudinally from an inlet of the refrigerant discharge pipe.

Figure 7:
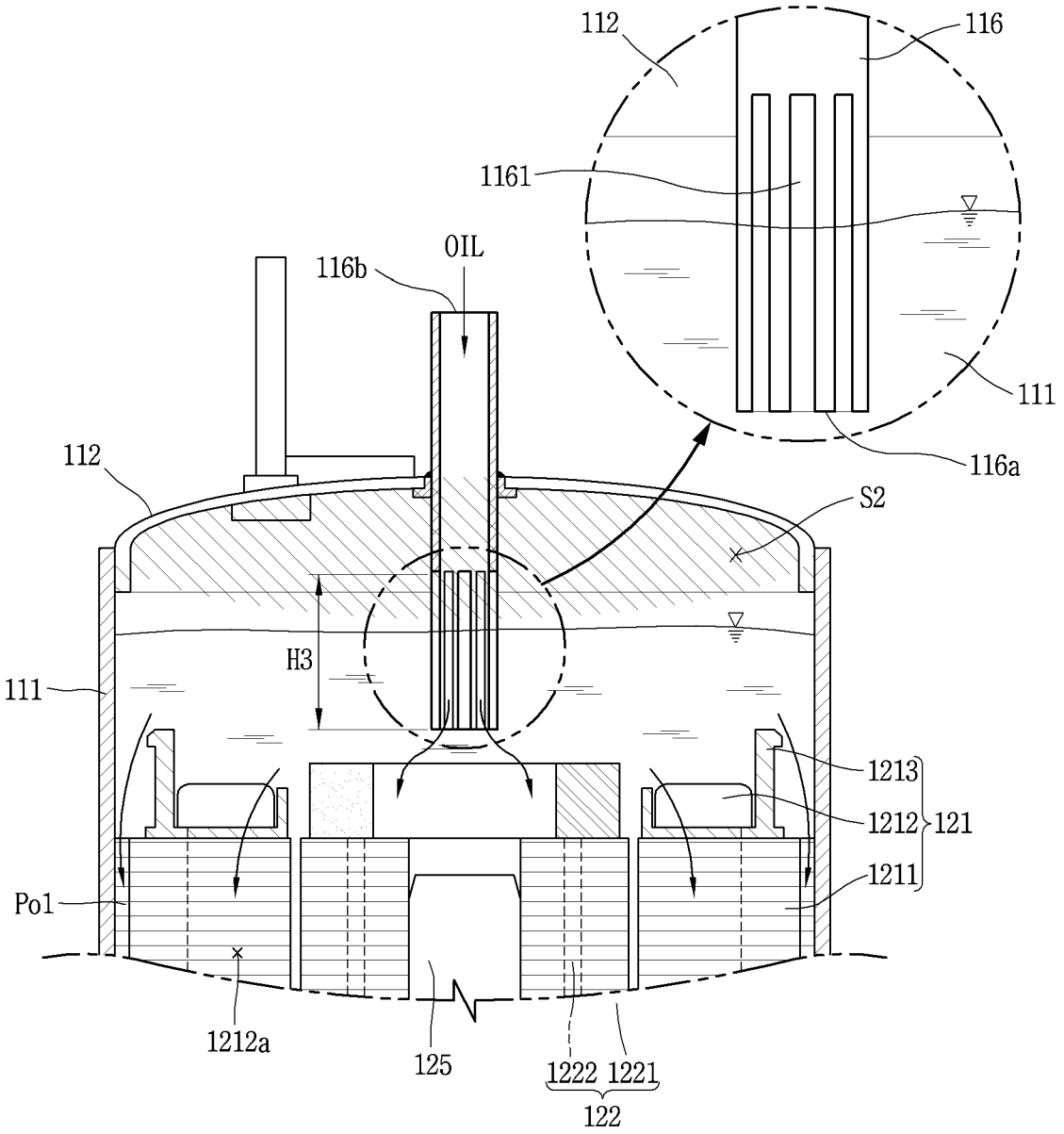
FIG. 7 is a longitudinal sectional view illustrating another implementation of a refrigerant discharge pipe.
Figure 8:
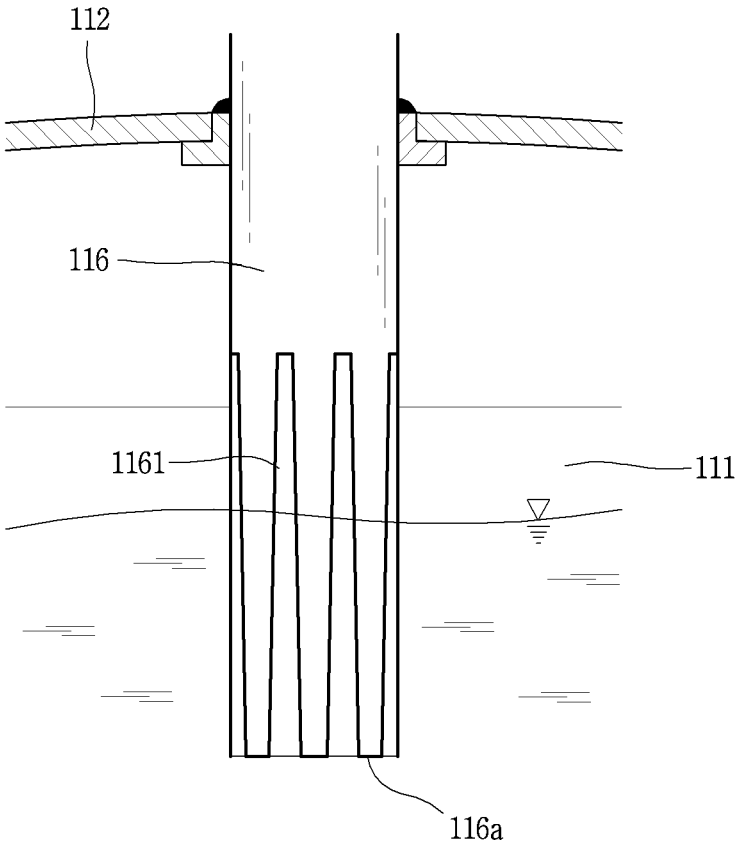
FIG. 8 is a longitudinal sectional view illustrating another implementation of a communication hole of FIG. 7.

FIG. 7 is a longitudinal sectional view illustrating another implementation of a refrigerant discharge pipe. FIG. 8 is a longitudinal sectional view illustrating another implementation of a communication hole of FIG. 7.

Referring to FIG. 7, the refrigerant discharge tube 116 according to this implementation may be inserted through a center of the upper shell 112 to communicate with the upper space S2. The refrigerant discharge tube 116 is provided such that the inlet 116*a* has a same inner diameter as that of the inlet 116*a*. This is identical to the above-described implementation. Thus, with respect to a description thereof, the description about the above-described implementation may be referred to.

In addition, the refrigerant discharge tube 116 is spaced apart from an upper end of the driving motor 120 by a preset distance. This is identical to the above-described implementation. Thus, with respect to a description thereof, the description about the above-described implementation may be referred to.

In addition, the communication hole 1161 is provided to penetrate through a circumferential surface of the refrigerant discharge pipe 116, and the hole height H3 and/or a sectional area (an opening area) of the communication hole 1161 are identical to those in the above-described implementation. Thus, with respect to a description thereof, the description about the above-described implementation may be referred to.

However, in this implementation, the communication hole 1161 is provided in a slit shape. For example, like FIG. 7, the communication hole 1161 may extend from the inlet 116*a* of the refrigerant discharge pipe 116 along a longitudinal direction in correspondence with a preset length. In other words, the communication hole 1161 may have a structure such that a lower end is cut at an end of the refrigerant discharge pipe 116 and an upper end is connected to a middle portion of the refrigerant discharge pipe 116 in a circumferential direction to thereby limit a slit length.

Accordingly, the communication hole 1161 may have an axial length greater than a circumferential length.

One communication hole 1161 may be provided, or a plurality of communication holes 1161 may be circumferentially provided to have a present space therebetween. When a plurality of communication holes 1161 are provided, the plurality of communication holes 1161 may be provided to have a same shape and/or a same sectional area. Accordingly, the communication hole 1161 may be easily formed, and backflow or overflow of oil may be also effectively suppressed.

The communication hole 1161 may be provided to have a same sectional area along a longitudinal direction (an axial direction of a rotating shaft). Thus, the communication hole 1161 may be easily machined.

As described above, when the communication hole 1161 has a slit shape, the communication hole 1161 has a smaller circumferential width compared to when the communication hole 1161 in a circular shape has a same sectional area (an opening area). Then, backflow or overflow of oil that may occur during oil sealing may be suppressed, and as an upper area of the communication hole 1161 having a slit shape is smaller than that of the communication hole 1161 having a circular shape, oil leak that may occur during operation of the compressor may be relatively reduced.

The communication hole 1161 may have different sectional areas along a longitudinal direction. For example, as illustrated in FIG. 8, the communication hole 1161 may have a sectional area (an opening area) gradually decreasing in a direction from the inlet 116*a* to the outlet 116*b*. Accordingly, as described above, backflow or overflow of oil that may occur during oil sealing may be suppressed, and oil leak that may occur during operation of the compressor may be relatively reduced.

Hereinafter, a description will be given of another implementation of a structure of prevention oil leak.

That is, in the above-described implementation, a height of a communication hole is optimized to suppress oil leak through the communication hole. However, in some cases, an oil blocking portion may be provided near a communication hole to suppress oil leak.

Figure 9:
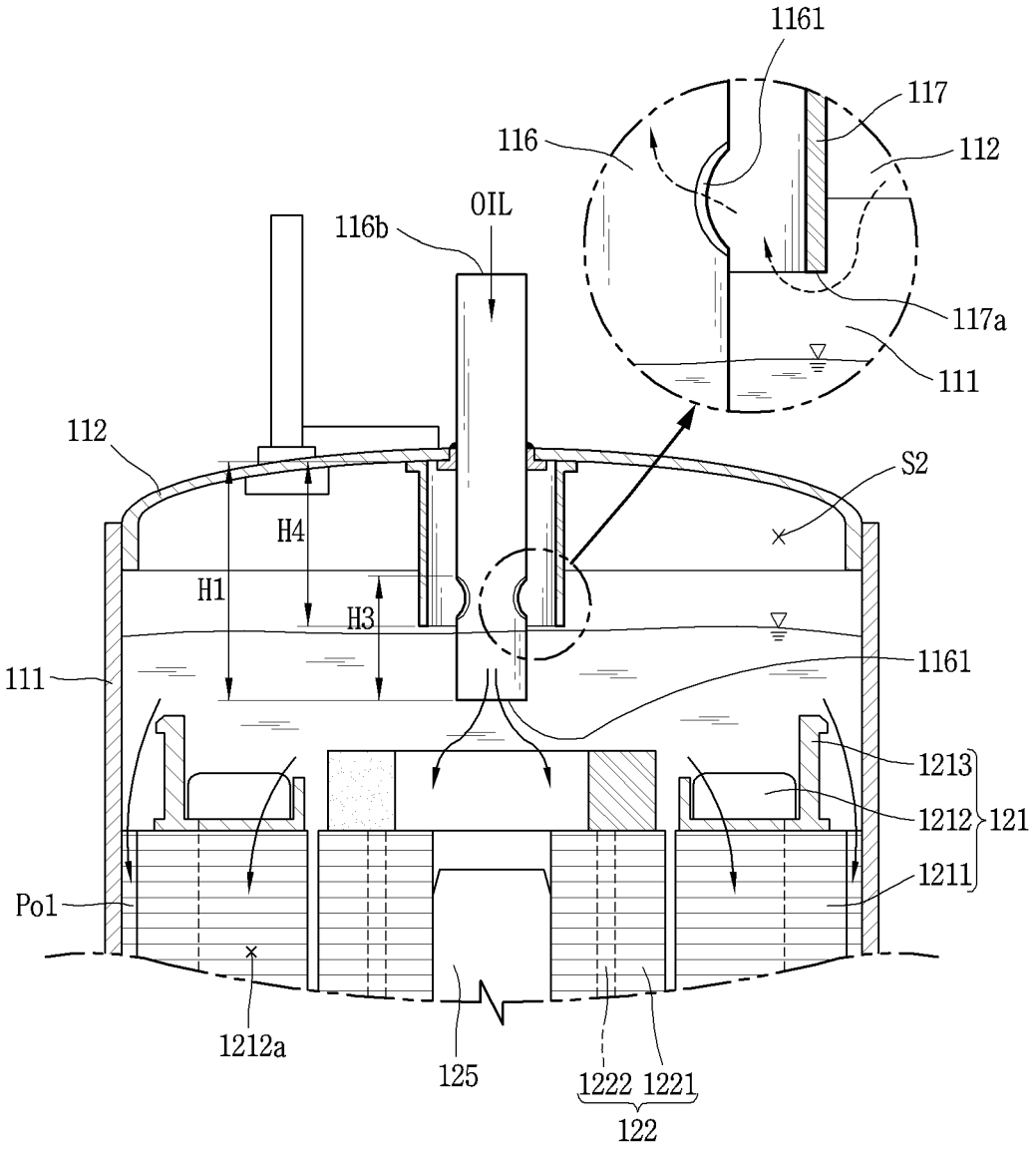
FIG. 9 is a longitudinal sectional view illustrating an implementation in which an oil blocking portion is included near the refrigerant discharge pipe.

FIG. 9 is a longitudinal sectional view illustrating an implementation in which an oil blocking portion is included near the refrigerant discharge pipe.

Referring to FIG. 9, the refrigerant discharge tube 116 according to this implementation may be inserted through a center of the upper shell 112 to communicate with the upper space S2. The refrigerant discharge tube 116 is provided such that the inlet 116*a* has a same inner diameter as that of the inlet 116*a*. This is identical to the above-described implementations of FIGS. 3, 4, 7, and 8. Thus, with respect to a description thereof, the description about the above-described implementations may be referred to.

In addition, the refrigerant discharge tube 116 is spaced apart from an upper end of the driving motor 120 by a preset distance. This is identical to the above-described implementations of FIGS. 3, 4, 7, and 8. Thus, with respect to a description thereof, the description about the above-described implementations may be referred to.

In addition, the communication hole 1161 is provided to penetrate through a circumferential surface of the refrigerant discharge pipe 116, and the hole height H3 and/or a sectional area (an opening area) of the communication hole 1161 are identical to those in the above-described implementations of FIGS. 3, 4, 7, and 8. Thus, with respect to a description thereof, the description about the above-described implementations may be referred to.

However, in this implementation, an oil blocking portion 117 surrounding the refrigerant discharge pipe 116 may be further included. For example, the oil blocking portion 117 may be provided to have a cylindrical shape to surround the refrigerant discharge pipe 116 from an outer circumference of refrigerant discharge pipe 116 to be apart with a preset space therebetween. In other words, a space through refrigerant may move may be ensured between an inner circumferential surface of the oil blocking portion 117 and an outer circumferential surface of the refrigerant discharge pipe 116.

An end of the oil blocking portion 117 may be post-coupled to or extend integrally with an inner circumferential surface of the upper shell 112. When the oil blocking portion 117 is post-coupled to the upper shell 112, a degree of freedom with respect to a material or thickness of the oil blocking portion 117 may be increased. In other words, when the oil blocking portion 117 is post-coupled, the oil blocking portion 117 may include a light material such as plastic other than metal as needed. On the other hand, when the oil blocking portion 117 is provided integrally with the upper shell 112, the oil blocking portion 117 may be easily provided, and thus, an increase in a manufacture cost may be suppressed.

A lower end 117*a* of the oil blocking portion 117 may be provided to elongate toward an upper end of the driving motor 120 as possible. In other words, a length H4 of the oil blocking portion 117 may be provided such that at least of the oil blocking portion 117 radially overlaps the communication hole 1161, the length H4 being defined as a length from an inner circumferential surface to an axial lower end of the upper shell 112. Thus, during oil sealing, oil sealing is not delayed due to the oil blocking portion 117, and the oil blocking portion 117 blocks oil at a circumferential portion of the communication hole 1161. Accordingly, oil in the upper space S2 may be suppressed from being leaked together with refrigerant through the communication hole 1161.

In addition, the lower end 117*a* of the oil blocking portion 117 may be provided at a height less than or same as that of the inlet 116*a* of the refrigerant discharge pipe 116 with reference to an inner circumferential surface of the upper shell 112. In other words, the lower end 117*a* of the oil blocking portion 117 may have a length not to overlap the inlet 116*a* of the refrigerant discharge pipe 116. Accordingly, during operation of the compressor, discharge resistance with respect to refrigerant moving toward the refrigerant discharge pipe 116 is reduced. Thus, deterioration of efficiency of the compressor that may be caused by the oil blocking portion 117 may be suppressed.

The oil blocking portion 117 may be provided in a plate or mesh shape. When the oil blocking portion is provided to have a plate shape, the oil blocking portion 117 may have a closed plate shape or a plate shape including fine through-holes like a mesh. Accordingly, the refrigerant and oil in the upper space S2 may avoid the oil blocking portion 117 and move toward the refrigerant discharge pipe 116 or may pass through the fine through-holes in the oil blocking portion 117 and move toward the refrigerant discharge pipe 116, to thereby facilitate oil separation. In this implementation, an example in which the oil blocking portion 117 is provided to have a closed plate shape.

As described above, when the oil blocking portion 117 is provided to surround the refrigerant discharge pipe 116 at an outer circumference of the refrigerant discharge pipe 116, refrigerant that moved to the upper space S2 during operation of the compressor may not move directly to the refrigerant discharge pipe 116, but bypass the oil blocking portion 117 and move to the refrigerant discharge pipe 116. Accordingly, as a moving distance of refrigerant mixed with oil is increased, an oil separation effect of separating the oil from the refrigerant may be enhanced.

In addition, in this case, since the communication hole 1161 in the refrigerant discharge pipe 116 opens regardless of the oil blocking portion 117, even when the inlet 116*a* of the refrigerant discharge pipe 116 is immersed in and blocked by oil stagnant in the upper space S2 during oil sealing, pressure (air) in the upper space S2 may move to the refrigerant discharge pipe 116 through a portion between the refrigerant discharge pipe 116 and the oil blocking portion 117, and through the communication hole 1161. Accordingly, excessive increase of the pressure in the upper space S2 is suppressed, and thus, sealed oil may be suppressed from flowing back or overflowing through the refrigerant discharge pipe 116.

Hereinafter, a description will be given of another implementation of a compressor to which a communication hole is applied in a refrigerant discharge pipe.

That is, in the above-described implementation, a communication hole is applied to a refrigerant discharge pipe of a scroll compressor. However, in some cases, a communication hole may be applied to a refrigerant discharge pipe of a rotary compressor FIG. 10 is a longitudinal sectional view illustrating a rotary compressor to which a refrigerant discharge pipe is adopted in accordance with this implementation.

Figure 10:
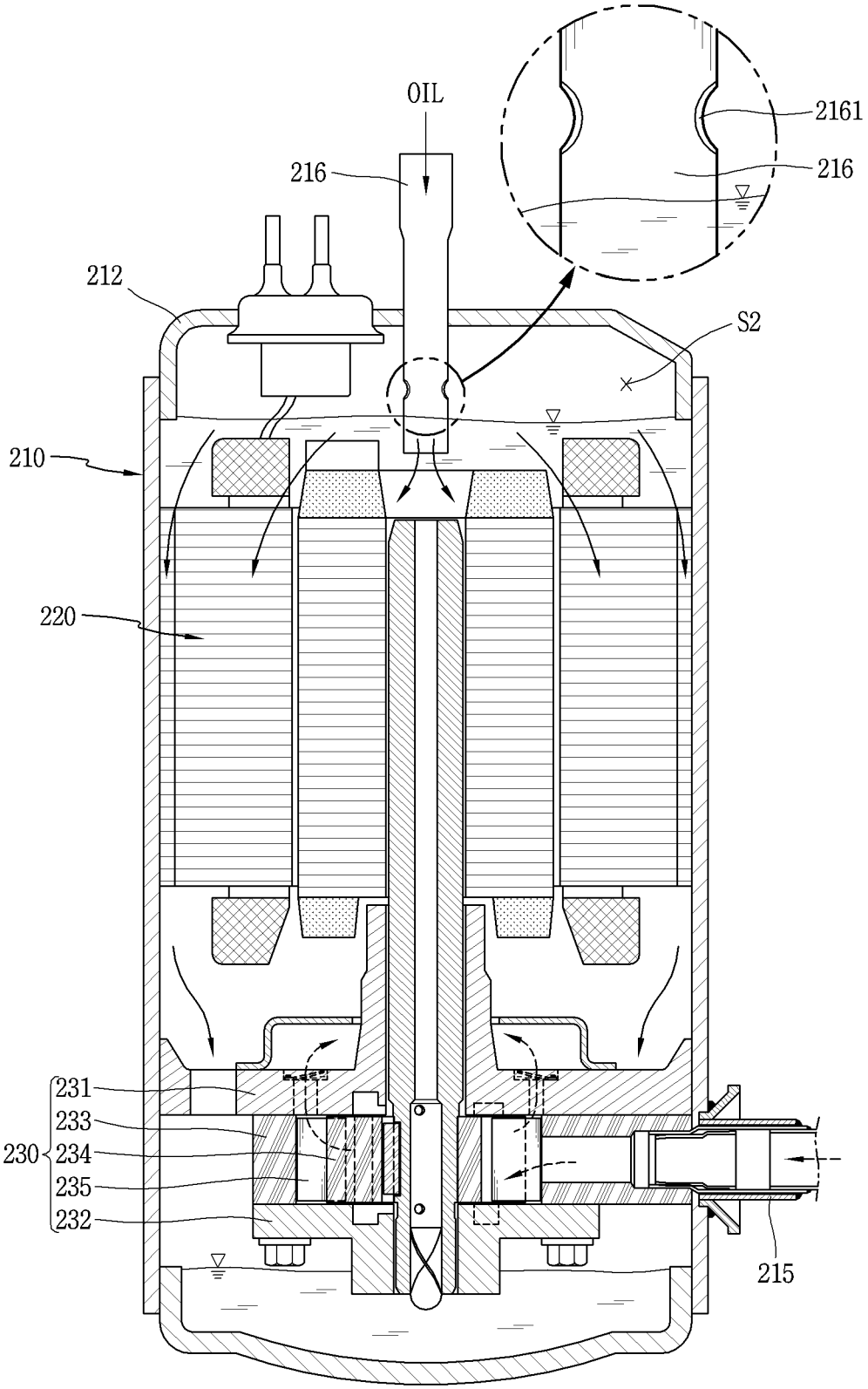
FIG. 10 is a longitudinal sectional view illustrating a rotary compressor to which the refrigerant discharge pipe is applied in accordance with this implementation.

Referring to FIG. 10, the rotary compressor according to this implementation may include a casing 210, a driving motor 220, the compression part C, a refrigerant suction pipe 215, and a refrigerant discharge pipe 216. The casing 210 and the driving motor 220 are almost identical to the casing 110 and the driving motor 120 in the scroll compressor described above. Thus, a description thereof is not provided here.

The compression part C may include a main bearing 231, a sub bearing 232, a cylinder 233, a roller 234, and a vane 235. The vane 235 may be slidably inserted into the cylinder 233 or the roller 234 according to a type of a compressor. In this implementation, an example in which the vane 235 is inserted into the roller 234 is illustrated. This implementation discloses a concentric rotary compressor. Thus, a detailed description thereof will not be provided here.

The refrigerant suction pipe 115 is inserted through the cylinder 233 to communicate with the compression chamber V. This is similar to the refrigerant suction pipe 115 in the scroll compressor described above, as well as in a general rotary compressor. Therefore, a detailed description thereof will not be provided here.

The refrigerant discharge pipe 216 is inserted through an upper end of the casing 210, i.e., a center of the upper shell 212 to extend toward an upper surface of the driving motor 220. A communication hole 2161 communicating with the upper space S2 of the casing 210 is provided in a middle portion of the refrigerant discharge pipe 216. A basic configuration such as an insertion depth and an inner diameter of the refrigerant discharge pipe 216 and an effect thereof are identical to those in the about the above-described implementation. Thus, with respect to a description thereof, the description about the above-described implementation may be referred to.

Even when an inlet of the refrigerant discharge pipe 216 is blocked during oil sealing, the communication hole 2161 suppresses sealing of the upper space S2 to suppress backflow or overflow of oil. A shape, a height, a sectional area, etc. of the communication hole 2161 according to this implementation are identical to those in the scroll compressor in the above-described implementations. Thus, with respect to a description thereof, the description about the above-described implementations may be referred to.

Although not illustrated, an oil blocking portion adopted in the scroll compressor may be applied to this implementation.

What is claimed is:

1. A compressor comprising:
a casing;
a driving motor provided at an inner space of the casing;
a compression part disposed at the inner space of the casing and configured to compress refrigerant;
a rotating shaft connecting the driving motor to the compression part and configured to transmit driving force of the driving motor to the compression part; and
a refrigerant discharge pipe positioned through the casing and extending between a first end and a second end, the refrigerant discharge pipe defining an inlet at the first end and an outlet at the second end, the inlet being in fluid communication with the inner space of the casing and being apart from an upper end of the driving motor,
wherein the refrigerant discharge pipe defines a communication hole between the inlet and the outlet, the communication hole extending between an outer circumferential surface of the refrigerant discharge pipe and an inner circumferential surface of the refrigerant discharge pipe, and
wherein an oil blocking portion surrounding the refrigerant discharge pipe is positioned apart from the refrigerant discharge pipe and is provided at an outer circumferential portion of the refrigerant discharge pipe.

2. The compressor of claim 1, wherein the communication hole is positioned apart from the inlet of the refrigerant discharge pipe.

3. The compressor of claim 2, wherein the communication hole has a circular opening shape.

4. The compressor of claim 2, wherein the communication hole has a non-circular opening shape elongating in a longitudinal direction.

5. The compressor of claim 1, wherein the communication hole extends from the inlet of the refrigerant discharge pipe and has a preset height.

6. The compressor of claim 5, wherein the communication hole has an opening area decreasing in a direction from the inlet of the refrigerant discharge pipe toward the outlet of the refrigerant discharge pipe.

7. The compressor of claim 1, wherein the communication hole includes a plurality of communication holes that are spaced apart from each other along a circumferential direction of the refrigerant discharge pipe, and
wherein the plurality of communication holes have a same opening area or are equally spaced apart from each other along the circumferential direction.

8. The compressor of claim 1, wherein an opening area of the communication hole is larger than or equal to an inlet area of the refrigerant discharge pipe.

9. The compressor of claim 1, wherein an opening area of the communication hole is smaller than an inlet area of the refrigerant discharge pipe.

10. The compressor of claim 1, wherein a distance from the inlet of the refrigerant discharge pipe to an upper end of the communication hole is less than half of a length of the refrigerant discharge pipe accommodated at the inner space of the casing.

11. The compressor of claim 1, wherein a distance from the inlet of the refrigerant discharge pipe to an upper end of the communication hole is greater than or equal to 0.2 to 0.3 times a value calculated by dividing a total amount of oil sealed into the inner space of the casing by a cross-sectional area of the casing.

12. The compressor of claim 1, wherein the oil blocking portion at least partially overlaps the communication hole of the refrigerant discharge pipe in a radial direction of the rotating shaft.

13. The compressor of claim 1, wherein a distance between (i) a lower end of the oil blocking portion and (ii) the upper end of the driving motor facing the lower end of the oil blocking portion in an axial direction of the rotating shaft is greater than or equal to a distance between (i) the inlet of the refrigerant discharge pipe and (ii) the upper end of the driving motor facing the inlet of the refrigerant discharge pipe in the axial direction of the rotating shaft.

14. The compressor of claim 1, wherein the compression part comprises:

an orbiting scroll coupled to the rotating shaft and configured to orbit; and a non-orbiting scroll configured to engage the orbiting scroll and define a compression chamber, and wherein an insertion depth of the refrigerant discharge pipe is greater than half of a distance between an upper end of the rotating shaft and an inner circumferential surface of the casing facing the upper end of the rotation shaft.

15. The compressor of claim 14, wherein an inlet area of the refrigerant discharge pipe is equal to an outlet area of the refrigerant discharge pipe.

16. The compressor of claim 1, wherein the compression part comprises:

a cylinder;

a roller inserted into the cylinder, included in the rotating shaft, and configured to rotate; and a vane slidably inserted into the cylinder, and wherein an insertion depth of the refrigerant discharge pipe is greater than half of a distance between an upper end of the rotating shaft and an inner circumferential surface of the casing facing the upper end of the rotation shaft.

17. The compressor of claim 16, wherein an inlet area of the refrigerant discharge pipe is equal to an outlet area of the refrigerant discharge pipe.

18. The compressor of claim 1, wherein the compression part comprises:

a cylinder;

a roller inserted into the cylinder, included in the rotating shaft, and configured to rotate; and a vane slidably inserted into the roller, and wherein an insertion depth of the refrigerant discharge pipe is greater than half of a distance between an upper end of the rotating shaft and an inner circumferential surface of the casing facing the upper end of the rotation shaft.

* * * * *